US007114968B2

(12) United States Patent
Healy

(10) Patent No.: US 7,114,968 B2
(45) Date of Patent: Oct. 3, 2006

(54) PLASTIC GATE FOR ELECTRICAL OUTLETS

(76) Inventor: Rafael Healy, Camino a la Sierra 8, San Andres Totoltepec, Tlalpan, Mexico City (MX) 14400

( * ) Notice: Subject to any disclaimer, the term of this patent is extended or adjusted under 35 U.S.C. 154(b) by 0 days.

(21) Appl. No.: 11/259,097

(22) Filed: Oct. 27, 2005

(65) Prior Publication Data

US 2006/0094272 A1 May 4, 2006

Related U.S. Application Data

(60) Provisional application No. 60/622,045, filed on Oct. 27, 2004.

(51) Int. Cl.
*H01R 13/44* (2006.01)

(52) U.S. Cl. ..... 439/137; 439/144

(58) Field of Classification Search ..... 439/137, 439/140, 142, 144
See application file for complete search history.

(56) References Cited

U.S. PATENT DOCUMENTS

| | | | | |
|---|---|---|---|---|
| 2,619,515 | A * | 11/1952 | Doane | 439/274 |
| 2,816,680 | A * | 12/1957 | Niemeyer | 220/242 |
| 3,571,779 | A * | 3/1971 | Collier | 439/587 |
| 3,676,974 | A | 7/1972 | Daly | |
| 3,990,758 | A | 11/1976 | Petterson | |
| 4,139,252 | A | 2/1979 | Gorny | |
| 4,243,284 | A | 1/1981 | Humphreys | |
| 4,462,650 | A | 7/1984 | Humphreys | |
| 4,479,687 | A | 10/1984 | Humphreys et al. | |
| 4,493,517 | A | 1/1985 | Hillary | |
| 4,544,219 | A | 10/1985 | Barkas | |
| 4,722,693 | A | 2/1988 | Rose | |
| 4,758,536 | A | 7/1988 | Miller et al. | |
| 4,773,869 | A | 9/1988 | Smart et al. | |
| 4,973,796 | A | 11/1990 | Dougherty et al. | |
| 5,226,724 | A | 7/1993 | Kanarek | |
| 5,316,490 | A | 5/1994 | Clemence et al. | |
| 5,391,088 | A | 2/1995 | Tomchak et al. | |
| 5,582,522 | A | 12/1996 | Johnson | |
| 5,645,437 | A | 7/1997 | Meir | |
| 5,688,132 | A | 11/1997 | Rogers et al. | |
| 5,788,517 | A | 8/1998 | Elmouchi | |
| 5,915,981 | A | 6/1999 | Mehta | |
| 6,290,516 | B1 | 9/2001 | Gerber | |
| 6,394,826 | B1 | 5/2002 | Baxter et al. | |
| 6,776,630 | B1 | 8/2004 | Huang | |

FOREIGN PATENT DOCUMENTS

| | | |
|---|---|---|
| EP | 0 451 970 A1 | 10/1991 |
| EP | 0 462 329 A2 | 12/1991 |
| EP | 0 512 208 A1 | 11/1992 |

(Continued)

*Primary Examiner*—James R. Harvey
(74) *Attorney, Agent, or Firm*—Richard C. Litman

(57) ABSTRACT

The electrical outlet with safety guard prevents children from inserting improper conductors, such as hairpins or paper clips, into the outlet. The outlet has an outlet body, a plurality of sockets within the body, a plurality of resilient gates pivotally attached to the body within the sockets, and a plurality of terminals at the ends of the sockets. The plug is inserted into the sockets, and the prongs are confronted with the resilient gates. Upon further pressure from the prongs, the gates pivot into cavities defined between the open end of the sockets and the terminals, so that the prongs make electrical contact with the conductors. The gates are sufficiently stiff that pins, paper clips, and other objects are deflected away from the terminals by the gates.

4 Claims, 4 Drawing Sheets

FOREIGN PATENT DOCUMENTS

EP 0 822 622 A2 2/1998

EP 1 032 081 A1 8/2000

* cited by examiner

PLASTIC GATE FOR ELECTRICAL OUTLETS

CROSS-REFERENCE TO RELATED APPLICATION

This application claims the benefit of U.S. Provisional Patent Application Ser. No. 60/622,045, filed Oct. 27, 2004.

BACKGROUND OF THE INVENTION

1. Field of the Invention

The present invention relates to electrical outlets, and particularly to electrical outlets having safety guards to protect children from electrical shock.

2. Description of the Related Art

Electrical outlets are frequent causes for concern to parents, due to the fact that young children often attempt to insert improper conductors, such as nails, pins, etc., into the outlet. Electrical shock, resulting in cardiac arrest, burns, or nerve damage, may occur when such objects are inserted into the outlet. As a result of this safety concern, numerous safety receptacles or devices including safety features have been developed and used.

Some devices that prevent children from electrical shock are protectors for outlets, such that the outlet may not be used until the device is removed. The protectors are often covers that either conceal the face of the outlet or cover the apertures of the outlet. In this manner, children are prevented from putting objects into the outlet, potentially causing electrical shock. The problem that results from these devices is that some children are somehow able to remove the cover from the outlet, giving them clear access to the outlet.

Some outlets may be made with shutter mechanisms that prevent other conductors from being inserted within the outlet. The shutter mechanisms generally only allow for the prongs of a plug to be inserted into the outlet. The shutters cover the apertures of the outlet and are forced aside when the prongs of a plug are inserted within the apertures. While these safety devices work effectively, the shutter mechanisms are generally spring-biased, necessitating the additional component of a spring. Additional components often add to the costs associated with devices.

Accordingly, there is a need for a device that is built into the outlet such that improper conductors are prevented from being inserted and that also omits unnecessary components. Thus, an electrical outlet with safety guard solving the aforementioned problems is desired.

SUMMARY OF THE INVENTION

The electrical outlet with safety guard is designed to accept electrical plugs within the outlet while preventing children from inserting improper conductors, such as hairpins or paper clips, into the outlet. The outlet accepts a plug having either two or three prongs. The outlet may either be a conventional electrical receptacle or may be part of a continuous baseboard outlet, such as that described in my prior patent, U.S. Pat. No. 6,644,988, issued Nov. 11, 2003.

The electrical outlet includes an outlet or socket body made of an electrically nonconductive material, a plurality of slots within the body defining sockets for receiving the prongs of an electrical plug, a plurality of resilient gates integrally attached to the body and biased to obstruct the slots, and a plurality of terminals disposed at the ends of the slots that are electrically connected to wiring leading to the AC power mains, or to a generator or other alternating current power source. The gates are attached to a portion of the outlet body internal to the body and along one side of the slots, and pivot into an adjacent cavity when a prong is pushed far enough into the slot.

The plug is inserted within the outlet, and the prongs of the plug enter the outlet slots. Two of the prongs (the neutral and hot prongs in a 120 volt polarized outlet, or the two hot prongs in a 240 volt outlet) are confronted with the resilient gates obstructing the slots, but upon further pressure by the user, each gate is forced backward into the cavity. The prongs are then able to make conductive contact with the terminals. Upon removal of the plug from the outlet, the gates retract to their original position.

The outlet may have only two slots for receiving a two prong plug, or may have a third slot for a grounding plug (the third slot may not have a gate, since the third slot is electrically connected to ground), or may have additional slots with resilient gates according to the number of current carrying wires desired for the outlet.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
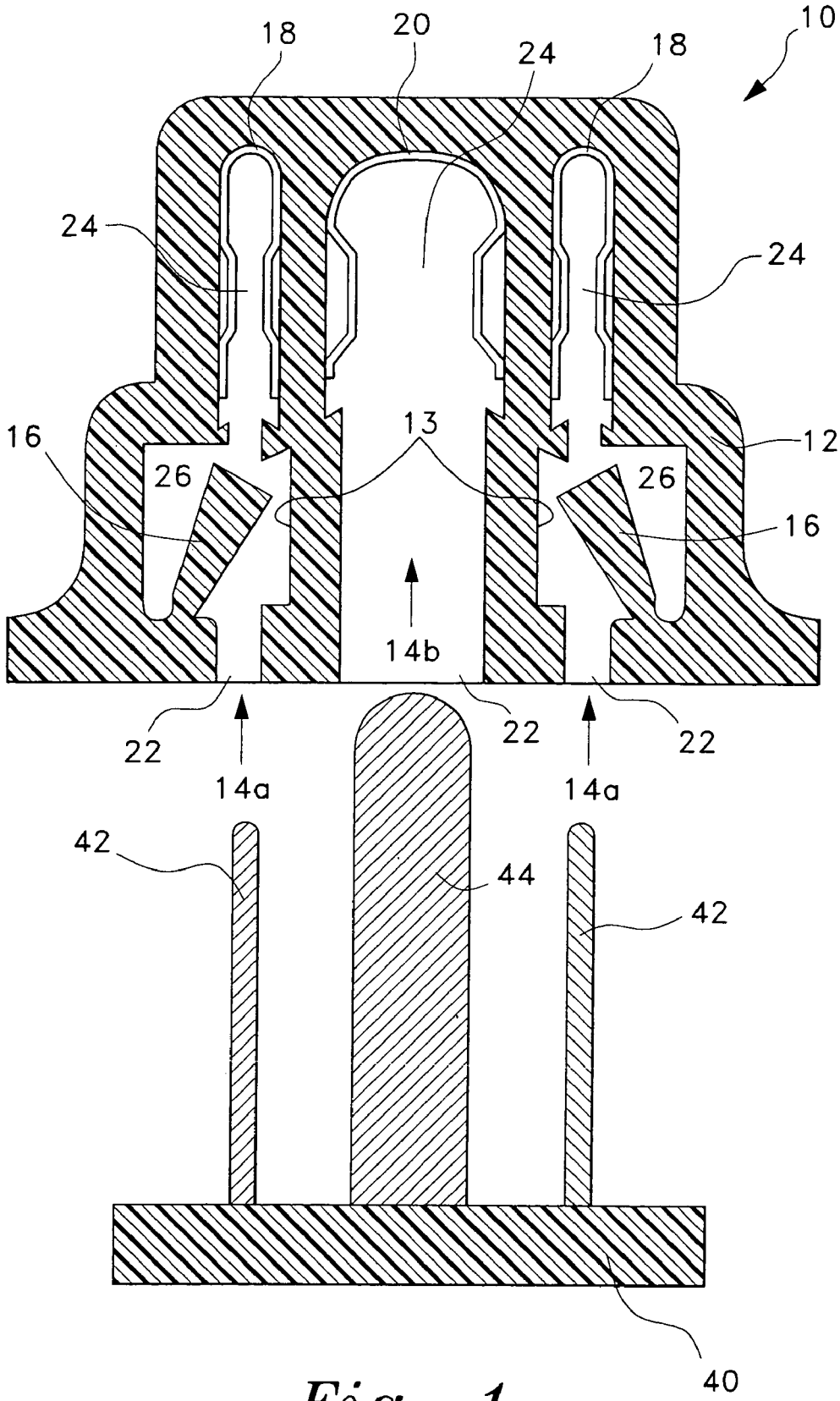
FIG. 1 is an environmental section view of an electrical outlet with safety guard according to a first embodiment of the present invention with a plug about to be inserted into the outlet.

The electrical outlet with safety guard is configured to accept electrical plugs and prevent children from inserting improper conductors into the outlet. FIG. 1 of the drawings provides a section view, which may be a horizontal section view of a conventional receptacle or a vertical section view through a continuous baseboard outlet when rotated 90°, of a first embodiment of the outlet with safety guard 10 and an electrical plug 40 adapted for insertion into the outlet 10. The plug 40 has a pair of outer conductive prongs 42 and a grounding prong 44 designed to engage the outlet 10. The outlet 10 may either be an electrical receptacle, e.g., a conventional duplex receptacle, or may be a continuous baseboard outlet, such as that described in my prior U.S. Pat. No. 6,644,988. The electrical outlet 10 has an outlet or socket body 12 made from an electrically non-conductive or insulating material, a plurality of slots 14*a* and 14*b* within the body 12 defining sockets adapted for receiving prongs 42 and 44, a plurality of resilient gates 16 fixed or integrally attached to the body 12, and terminals 18 and 20 at the ends of the sockets that are adapted for attachment to wiring connected to the AC power mains, or to a generator or other alternating current power source. The outlet 10 depicted in FIG. 1 is designed to receive a three-prong grounded electrical plug 40.

Within the outlet body 12, each slot or socket 14*a* has an open end 22, a longitudinally-extending recess 24 aligned with open end 22 in which terminals 18 are mounted, and a box-shaped cavity 26 between open end 22 and recess 24 that has a portion longitudinally offset from open end 22. The middle slot 14*b* does not have a cavity 26, but has terminal 20 disposed in recess 24. Resilient gates 16 are fixed or formed integrally with a portion of the outlet body 12 defining cavity 26 adjacent open end 22. Gates 16 are shown wedge-shaped in horizontal section in the drawings, but may have other shapes or configurations. The gates 16 are made from electrically nonconductive or insulating material, such as plastic. Gates 16 extend into the path between open end 22 and recess 24, obstructing the passage of objects through the open end 22 to prevent contact with terminals 18.

Figure 2:
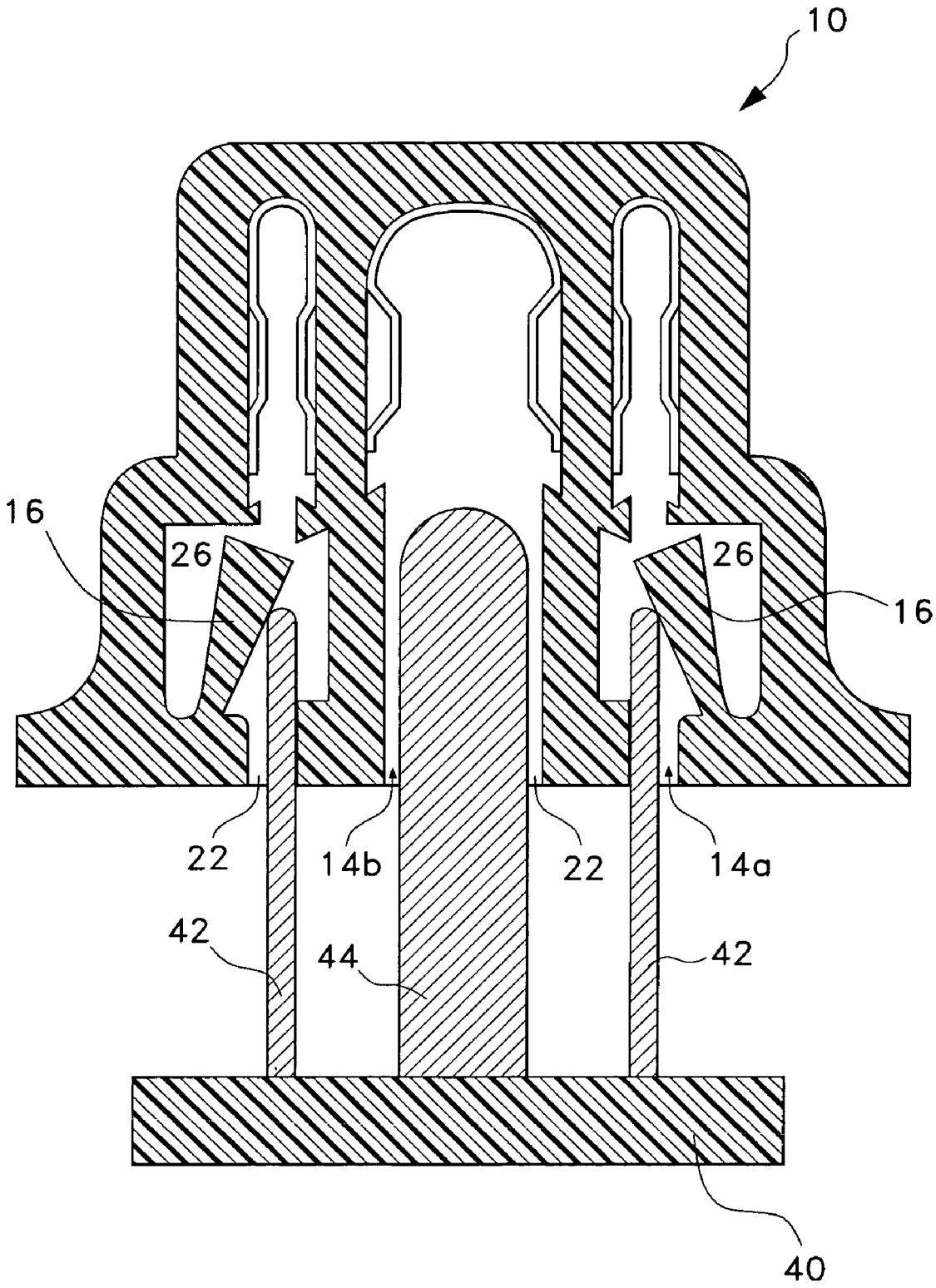
FIG. 2 is an environmental section view of the electrical outlet with safety guard according to the first embodiment of the present invention with the plug partially inserted into the outlet.

Turning now to FIG. 2, a section view of the electrical outlet 10 is shown with the plug 40 partially inserted into the outlet 10. The prongs 42 and 44 are forced by a user through the open ends 22 of the slots 14*a* and 14*b*. The grounding prong 44 enters without obstruction. As the outer prongs 42 are inserted within the outlet 10, the outer prongs 42 are initially contact the resilient gates 16. Upon further insertion of the plug 40, the gates 16 are forced backward into a portion of the cavity 26 lateral to the path between the open end 22 and the recess 24. The resilient gates 16 are made of any flexible material that would allow them to bend, for example, plastic material. The gates 16 provide enough opposing resisting force that such conductors as hairpins or paper clips will not force the gates 16 back upon insertion within the outlet 10, but are deflected towards the opposite wall 13 of the box-shaped cavity 26.

Figure 3:
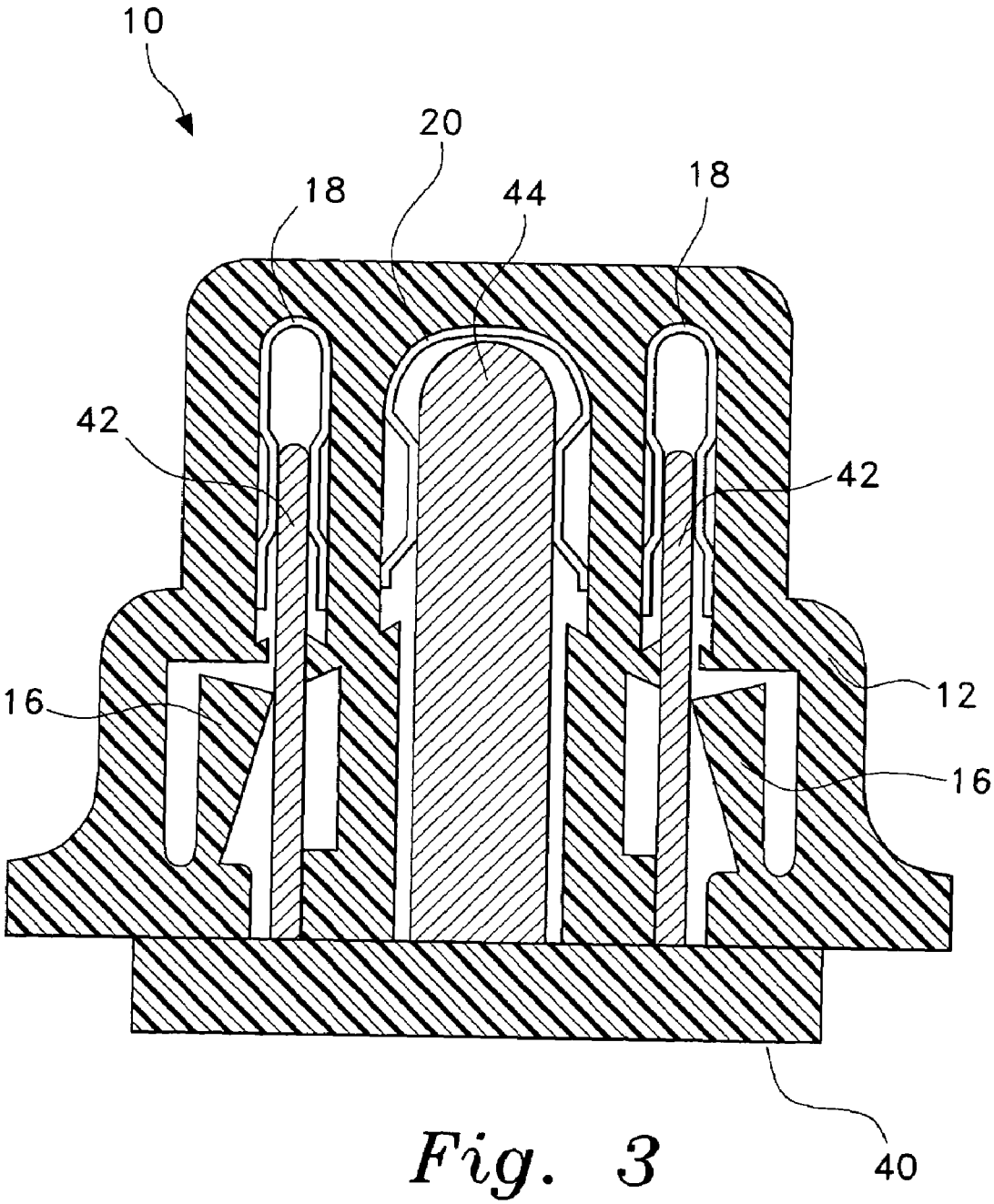
FIG. 3 is an environmental section view of the electrical outlet with safety guard according to the first embodiment of the present invention with the plug fully inserted into the outlet.

FIG. 3 shows the electrical outlet 10 with the plug 40 fully inserted into the outlet 10. The outer prongs 42 of the plug 40 push past the resilient gates 16, forcing the gates 16 further back. The outer prongs 42 then make conductive contact with the terminals 18, and the grounding prong 44 makes contact with the grounding conductor 20. The plug 40 is held flush against the outlet 10. When the plug 40 is later removed from the outlet 10, the gates 16 retract to their original position.

Figure 4:
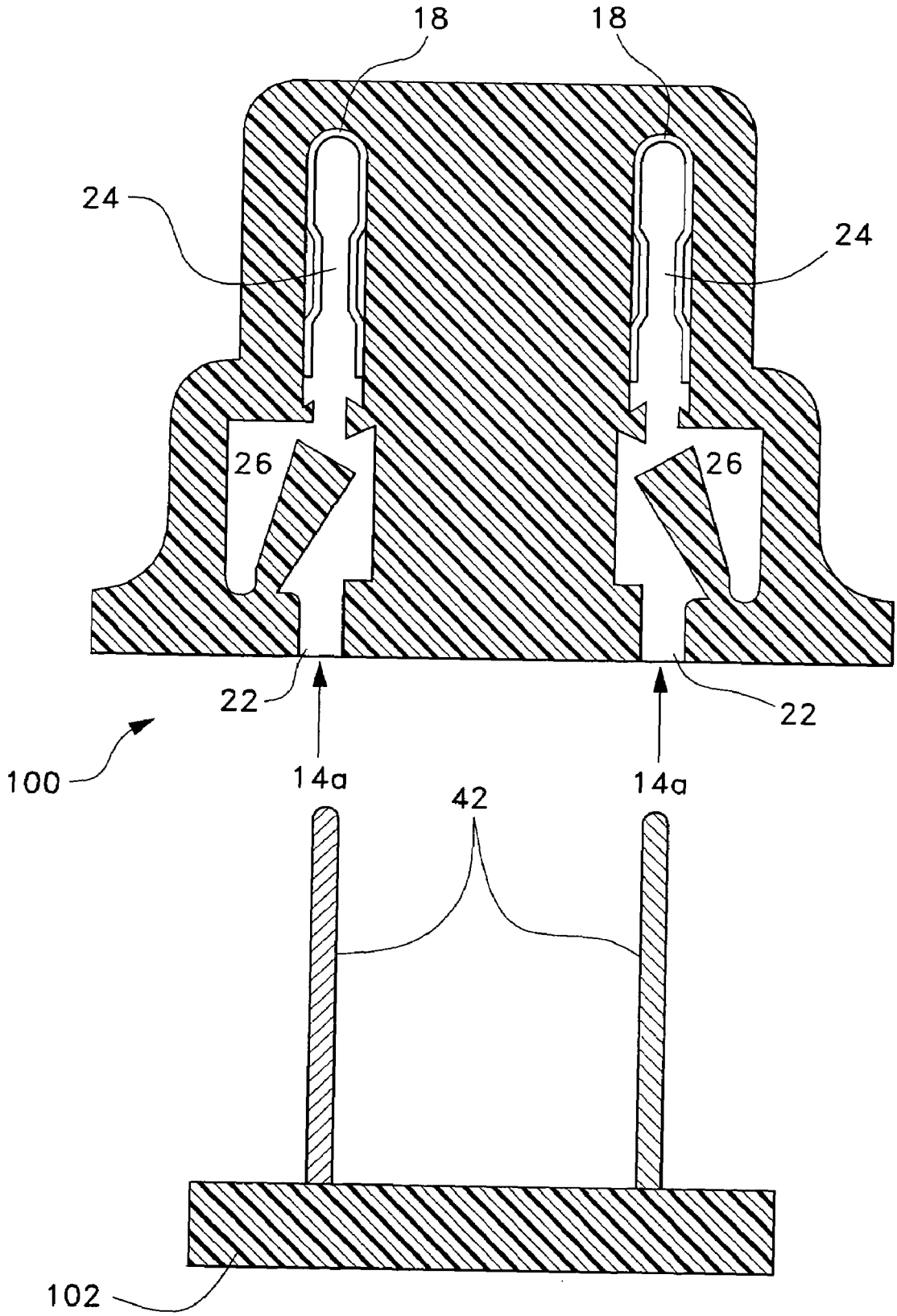
FIG. 4 is an environmental section view of the electrical outlet with safety guard according to a second embodiment of the present invention with a plug about to be inserted into the outlet.

FIG. 4 is a section view, similar to FIG. 1, of a second embodiment of the electrical outlet with safety guard 100 and a two-pronged plug 102. The outlet 100 is adapted to receive a plug 102 with two conductive prongs 42. The outlet 100 omits the middle slot 14*b* containing the grounding prong 44. The outlet 100 has two slots 14*a*, each slot 14*a* having an open end 22 and a longitudinally extending recess 24. Within each recess 24 is a terminal 18, which the prongs 42 contact upon insertion of the plug 102 within the outlet 100. Two resilient gates 16 are located adjacent to the open ends 22 of the slots 14*a* and are held within cavity 26.

It is to be understood that the present invention is not limited to the embodiments described above, but encompasses any and all embodiments within the scope of the following claims.

I claim:

1. An electrical outlet with safety guard for operation with an electrical plug having conductive prongs, said electrical outlet comprising:

an outlet body made from electrically non-conductive material and having a plurality of sockets within said outlet body;

each of said plurality of sockets comprising:

an open end, a longitudinally-extending recess opposite said open end, and a box-shaped cavity disposed between said open end and said recess, said box-shaped cavity having offset portions lateral to left and right sides of a path between said open end and said recess, a resilient, wedge-shaped gate having a corner thereof flexibly attached to said outlet body within one of said offset portions of said cavity, said gate disposed in a first position extending entirely across and blocking the path between the open end and said recess;

a conductive terminal disposed in said recess, the terminal being adapted for electrical connection to an alternating current power source;

wherein each socket of said plurality of sockets is adapted to receive a conductive prong of an electrical plug, each said resilient, wedge-shaped gate being angularly displaced to a second position into said one of said offset portions of said cavity when said gate is contacted by the conductive prong of an electrical plug inserted into said socket open end, said gate retracting to said first position upon removal of the conductive prong from the socket; and wherein when said resilient, wedge-shaped gate is in said first position it provides a camming surface and an opposing resisting force sufficient to deflect conductors such as hairpins or paper clips, inserted into said socket open end, toward an opposite wall of said box-shaped cavity and thereby prevent the conductors from contacting said conductive terminal.

2. The electrical outlet of claim 1, wherein said resilient gates are made of a non-conducting material.

3. The electrical outlet claim 1, wherein said resilient gates are made of plastic.

4. The electrical outlet of claim 1, wherein said outlet further comprises a ground prong socket defined therein for accommodating a three-prong plug.

* * * * *